US006062710A

United States Patent [19]

Hewitt

[11] Patent Number: 6,062,710

[45] Date of Patent: May 16, 2000

[54] LIGHT FIXTURE WITH AT LEAST ONE LENS OR REFLECTOR AS IMAGE MAGNIFIER AND A DIFFUSER FOR REDUCING GLARE

[75] Inventor: Fred G. Hewitt, Eagan, Minn.

[73] Assignee: Lighten Up Trading Company, Inc., Eagan, Minn.

[21] Appl. No.: 09/090,356

[22] Filed: Jun. 4, 1998

[51] Int. Cl.[7] ..... F21V 11/00

[52] U.S. Cl. ..... 362/351; 362/355; 362/245; 362/246; 362/268; 362/311; 359/19; 359/599; 359/615

[58] Field of Search ..... 362/351, 355, 362/245, 246, 268, 311; 359/19, 599, 615

[56] References Cited

U.S. PATENT DOCUMENTS

| | | | |
|---|---|---|---|
| 2,038,409 | 4/1936 | Bone | 40/564 |
| 3,588,492 | 6/1971 | Pollock | 362/309 |
| 3,933,408 | 1/1976 | Reinert | 359/385 |
| 4,206,494 | 6/1980 | Lovering | 362/554 |
| 4,644,454 | 2/1987 | Herst et al. | 362/224 |
| 4,719,549 | 1/1988 | Apel | 362/398 |
| 4,779,178 | 10/1988 | Spitz | 362/260 |
| 4,969,075 | 11/1990 | Helm et al. | 362/330 |
| 5,079,675 | 1/1992 | Nakayama | 362/31 |
| 5,150,966 | 9/1992 | Nelson | 362/337 |
| 5,493,481 | 2/1996 | Wiegand | 362/249 |
| 5,530,628 | 6/1996 | Ngai | 362/33 |
| 5,582,474 | 12/1996 | Van Order et al. | 362/490 |
| 5,618,102 | 4/1997 | Ferrell | 362/516 |
| 5,645,337 | 7/1997 | Gleckman | 362/29 |
| 5,674,001 | 10/1997 | Weigert | 362/308 |

*Primary Examiner*—Sandra O'Shea
*Assistant Examiner*—Ronald E. Delgizzi
*Attorney, Agent, or Firm*—Nikolai, Mersereau & Dietz, P.A.

[57] ABSTRACT

This invention is a light fixture concept using geometrical optical elements and optical diffusors which produce a controlled light beam from a large lighting aperture. The object of this invention is to provide for both low surface luminance of the light fixture aperture and directional control of the light distribution. The geometrical optical elements are placed so as to result in a magnification of the light source, and diffusor elements are used to shape the light beam. A wide range of light sources can be used with this concept. The resulting light fixture will have reduced glare characteristics due both to the decreased luminance of the fixture aperture and to the restricted lighting angle distribution. These light fixtures should find application in a large number of lighting situations.

10 Claims, 9 Drawing Sheets

LIGHT FIXTURE WITH AT LEAST ONE LENS OR REFLECTOR AS IMAGE MAGNIFIER AND A DIFFUSER FOR REDUCING GLARE

BACKGROUND OF THE INVENTION

I. Field of the Invention

This invention relates generally to lighting fixtures for residential, commercial and industrial use, and more particularly to the design of light fixtures for reducing disability glare and veiling glare without a significant loss in luminous or light output from the fixture.

II. Discussion of the Prior Art

An important aspect of light fixture design is to control glare. Light sources produce several kinds of glare. One kind of glare is discomfort or disability glare. This is due to the light source being in the field-of-view of an individual. Discomfort or disability glare can be reduced by keeping the light source out of the field-of-view. However, in many applications, this can not be done. One such application is stage and similar lighting which must be directed onto individuals. This invention can increase the size area of the source image and reduce surface luminance so that the illumination can be maintained or adjusted to desired levels. By controlled spreading of the light source, illumination can be achieved with reduced discomfort or disability glare.

A second kind of glare is veiling glare, which is due to specular reflection from glossy surfaces. The image of the light source overlays the image on the glossy surface reducing contrast and, therefore, visibility. One of the means for reducing veiling glare is to control the light beam from the fixture to eliminate illuminating angles that would produce veiling glare in specified applications. In conventional light fixture designs, the distribution of the light is usually controlled by reflector design. For precise directional control of light, specular reflectors are used. (See "The Optical Design of Reflectors" by William B. Elmer, John Wiley & Sons, 1980.) If transmission optics are used, they are generally used to supplement the reflector design or to provide protection of the light fixture from the environment. This addition of transmission optics to light fixtures lowers the efficiency due to losses in the transmission optics and are, therefore, shunned by some designers. (See W. B. Elmer, cited above.) Specular reflector optics can be used to reduce some veiling glare by careful control of the light beam. Baffles are sometimes added to improve or limit the beam. However, they do not reduce the direct disability glare. Diffusing reflectors can lower the disability glare but are much less effective in reducing veiling glare due to the loss of directional control. Another method for reducing disability glare is to place a large area diffusor in front of the light source. This lowers the surface luminance of the light fixture, but also reduces the control of the light direction which can result in veiling a glare. A light fixture with both lowered surface luminance and controlled light beam direction would provide for significant glare reduction in a wide range of applications.

SUMMARY OF THE INVENTION

The present invention comprises a light fixture having a light source positioned to direct the light energy therefrom through image enlarging optics and thence through a diffusor for controlling the shape and distribution of the light beam exiting the fixture. The image enlarging optics may comprise a convex lens, a fresnel convex lens, a combination of concave and convex lenses, a curved reflector or any combination of these imaging optics. The diffusor is preferably a translucent material shaped and positioned to intersect the light rays emanating from the magnifying optics.

DESCRIPTION OF THE PREFERRED EMBODIMENT

It is the object of the present invention to provide lighting fixtures exhibiting lower surface luminance while still maintaining desired directional control. It is accomplished in a two-step optical process. The first step is to use imaging optics to provide for a magnified image f the light source. The second step in implementing a reduced-glare light fixture in accordance with the present invention involves adding a diffusor to expand the light beam to a desired distribution pattern.

Figure 1:
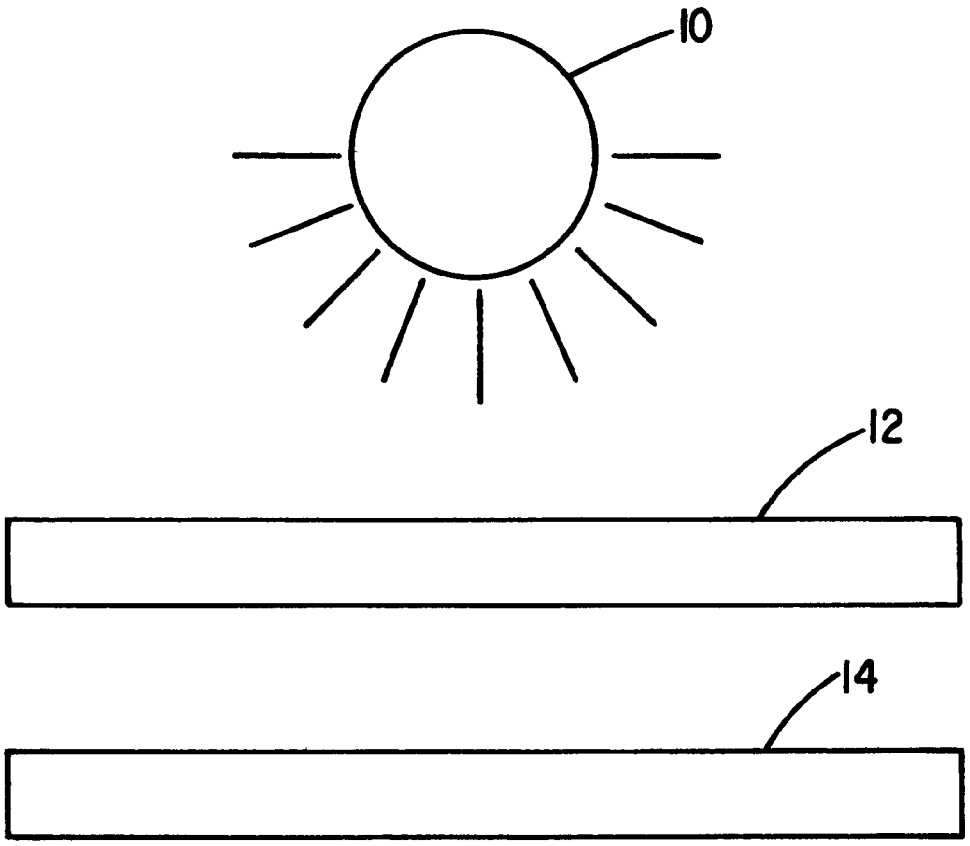
FIG. 1 is a schematic diagram helpful in understanding the overall concept in the design of reduced-glare light fixtures in accordance with the present invention.

Referring first to FIG. 1, light rays emanating from a source 10 first pass through imaging optics 12 that are designed to enlarge the image of the light source 10. The use of such optics also generally has an attendant drawback in that the optics tends to focus the light resulting in a distribution that is unfavorable in many lighting situations. To obviate this drawback, the light exiting the imaging optics 12 is made to pass through a diffusor 14 designed to spread the light into a desired beam pattern.

Thus, the combination of the image enlarging optics 12 and the light diffusor 14 combines to result in a light fixture having a large, low luminance surface with directional beam control.

In accordance with the present invention, the imaging optics may consist of a single optical element or a combination of optical elements. These optical elements may be either refractive, reflective or holographic. For a single optical element, the magnification is equal to f/(f-s) where f is the focal length of the optical element and s is the distance of the object light source from the optical element. The magnification can be selected by the proper combination of focal length and distance.

The optic elements should be of sufficient size to pass the light output of the magnified image so as not to significantly reduce total light output. Ideally, the fixture should be structured so as to capture all of the light from the source 10 and direct it through the optics. The magnified image of the light source does not necessarily reduce the surface luminance as might be expected. If the focusing elements do not introduce losses, the surface luminance is unchanged. This is known in optics as Abbe's Law. In actual practice, however, the surface luminance will decrease due to refraction and reflection losses. The inability of reflective optics, refractive optics or any passive optical element to increase luminance is also sometimes referred to as "the first law of lighting". Surface luminance does not necessarily decrease because as the image size changes, focusing of the light beam changes in a way to keep the luminance from decreasing.

As already stated, the function of the imaging optics 12 is to produce a magnified image of the light source with a minimal loss in light energy and, therefore, minimal reduction in surface luminance. The resulting light beam is more focused than the light beam emitted directly from the source and will be unsatisfactory for most lighting situations.

To obviate this drawback, the diffusor 14 is used to expand the light beam to a desired distribution pattern. The diffusor lowers the surface luminance of the light fixture without changing the image size of the light source. Since the object of this invention is to provide for beam control over specified ranges, the diffusor elements 14 must be properly selected. Many, if not most, diffusors have a very wide diffusion pattern and their use would negate controlled beam patterns. However, there are diffusers exhibiting a limited diffusion angular range. Included are such devices as etched glass and peened aluminum sheet. More recently, diffusers have been developed exhibiting a very controlled angular distribution pattern. For example, one of these is the holographic light shaping diffusor available from Physical Optics Corporation of Torrance, Calif. These light shaping diffusers can be made with a wide variety of distribution angles. Two common distributions are circular and elliptical. The angle of diffusion for a circular diffusor can range from 1° to 70°. For elliptical diffusers, the major axis angle can be as great as 140° with elliptical ratios of up to 50:1, depending on the major axis angle. A wide range of other distributions may also be possible. At the present stage of optical element research, it should be expected that there will be considerable advances in the field of precision optical diffusers.

Large area, low-luminance light fixtures should be very beneficial in a number of lighting applications. Stage lighting has already been mentioned. Another possibility is vehicle headlights. Reduced glare is important for improved visibility of drivers approaching from an opposite direction. In accordance with the present invention, headlights can extend over the entire width of the vehicle to increase light output for illuminating the road ahead while lowering surface luminance and disability glare for on-coming traffic. Control of both the dimensions of the luminance source and image magnification can be made to provide optimal image magnification. If a holographic diffusor element is used, beam shape characteristics may be tailored to tightly specified distributions. In architectural applications, ceiling fixtures can be designed that have the benefits of both large area light fixtures that reduce surface luminance and small, tightly baffled fixtures that are narrowly directional. A light fixture with both sets of characteristics would have many applications, such as ceiling fixtures, street lights and highway lights. Another application would be task lighting for desks and other work areas. This light fixture design reduces discomfort glare by its directional control, and reduces veiling glare by its large area and low surface luminance. In addition, its large area would tend to reduce shadowing problems.

The light source 10 may be any one of a variety of devices including incandescent bulbs, halogen spotlight bulbs, floodlight bulbs, fluorescent bulbs of all shapes and sizes, LEDs, fiber optic illuminators, electroluminance panels, etc.

Figure 2:
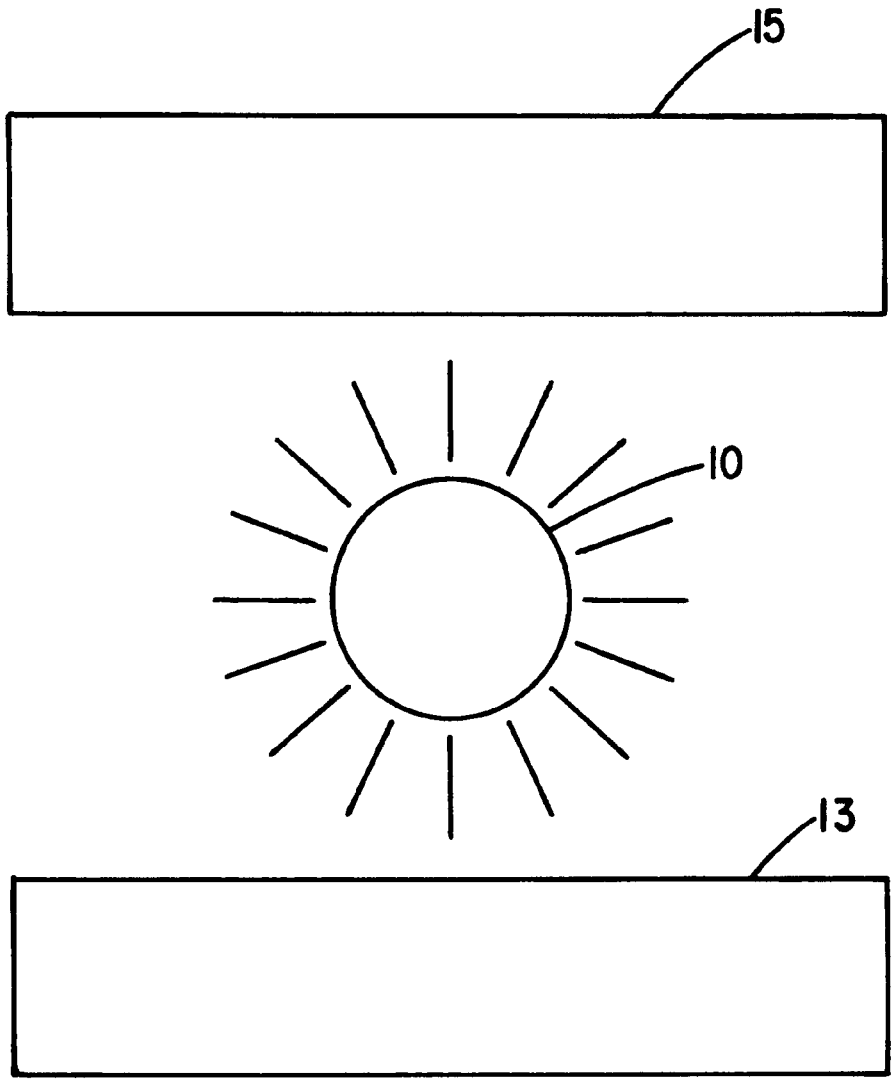
FIG. 2 is a schematic diagram of a light fixture having more than a single set of optics incorporated therein.

FIG. 2 illustrates by means of a schematic diagram light fixture having more than a single set of optics. n this case, there is one set of light fixture optics 13 on one side of the light source 10 and a second set of light fixture optics 15 on the opposite side. For example, in a hanging ceiling fixture, it may prove desirable to have a first kind of light distribution aimed downward at the floor at a different light distribution aimed at the ceiling. Those skilled in the art will appreciate that the number of light fixture optics around the light sources need not be limited to only two. Light fixture optics 13 and 15 each include imaging optics and a diffusor.

Figure 3:
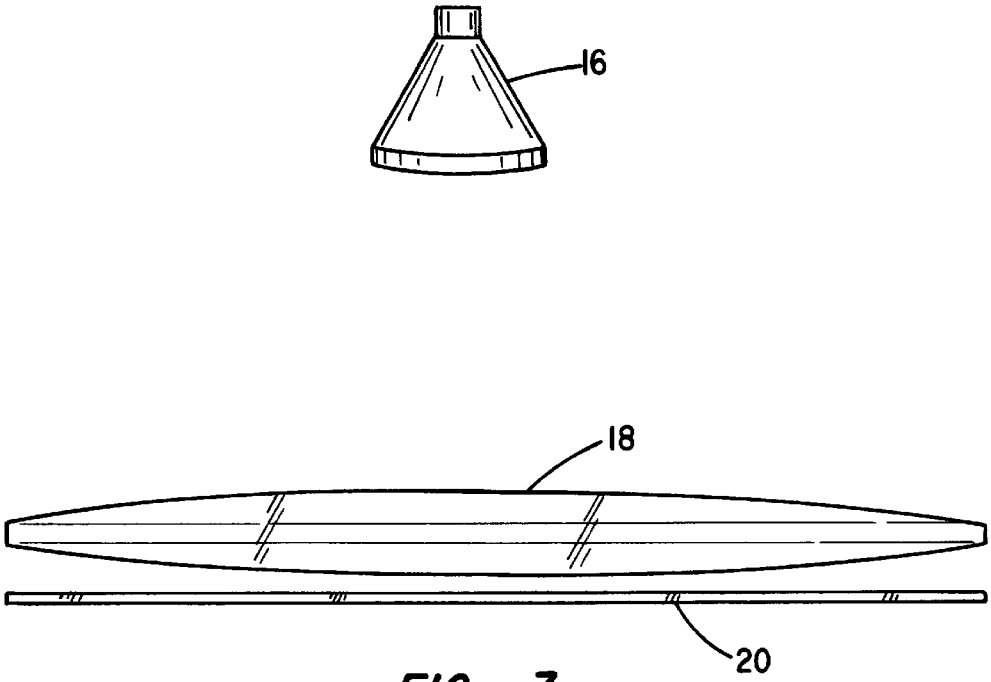
FIG. 3 illustrates a first simple implementation of the light fixture concept of the present invention.

FIG. 3 shows a practical implementation of the light fixture concept contemplated by the present invention. Here, the light source is a single spot or floodlight bulb 16 directing its light rays onto the imaging optics, here shown as a convex lens 18 that is set at a predetermined distance from the source 16 to obtain a desired degree of magnification of the front surface of the spotlight 16. The diameter of the convex lens 18 should be designed to capture the beam width of the spotlight source. A diffusor element 20 is selected to provide the desired beam spread distribution.

Figure 4:
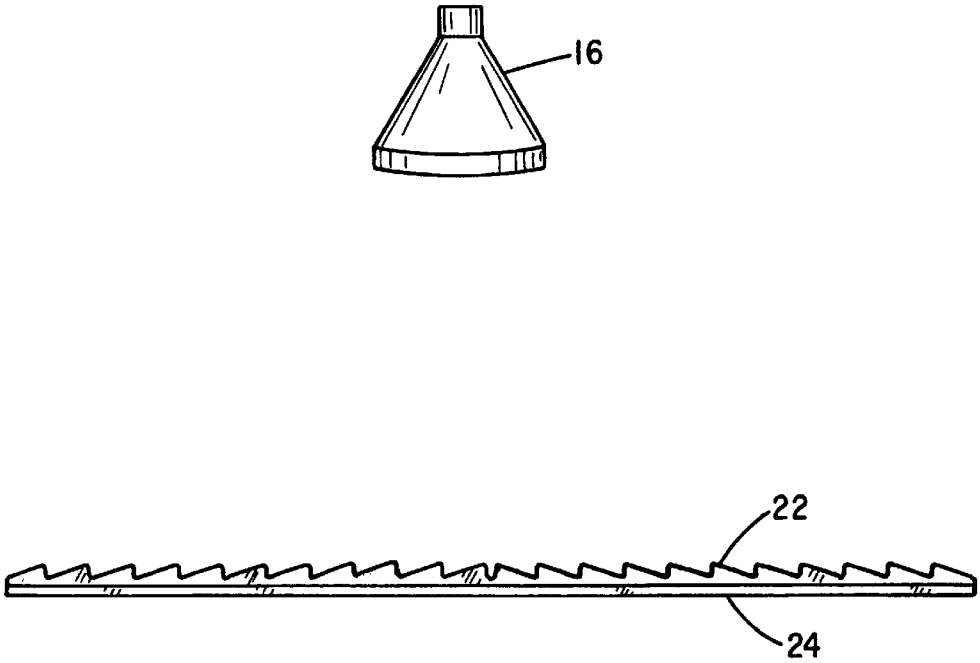
FIG. 4 is a modified version of the configuration of FIG. 3 having two separate image magnifying and diffusing elements replaced with a single optical element.

Referring next to FIG. 4, there is shown a modified version of the light fixture configuration shown in FIG. 3. In this configuration, a fresnel convex lens 22 is disposed on a first surface of the diffusing element 24 which is closest to the light source. This configuration may be used to provide a more compact lighting fixture. The convex fresnel lens 22 functions to magnify the image of the face of the spotlight 16 while the diffusing element 24 provides the desired beam spread pattern.

Figure 5:
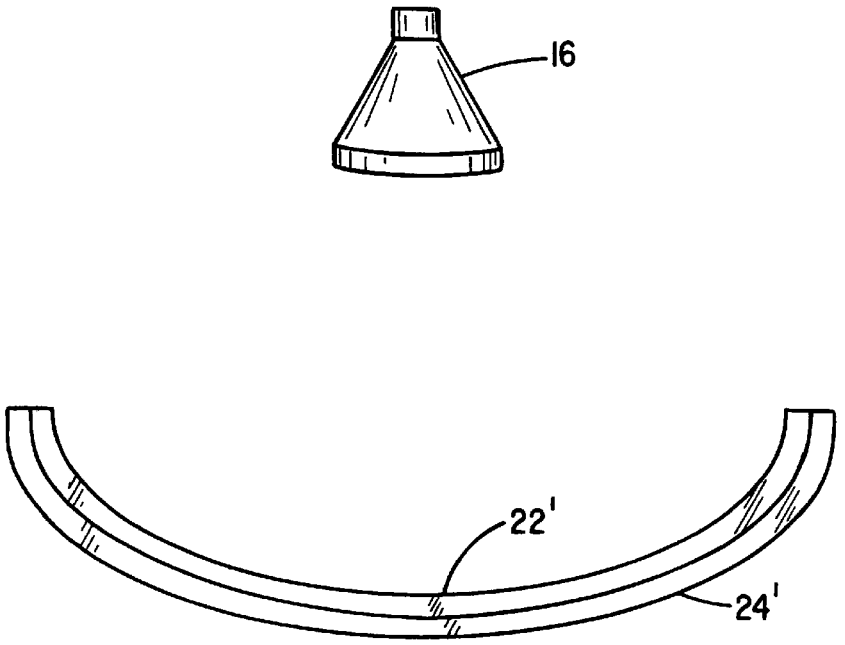
FIG. 5 illustrates a non-planar version of the configuration of FIG. 4.

With reference to FIG. 5, it shows that the optical elements 16 need not be planar and can be wrapped around the light source 16 in a generally spherical or cylindrical manner. Here, the optical element is shown as a fresnel convex lens whose radius of curvature may be either constant or variable. In FIG. 5, the curvature of the optic element used to magnify the image of the face of the spotlight 16 varies over its surface. Further, the magnification and the diffusion characteristics of the magnifying layer 22' and the diffusing layer 24' need not be constant over its entire surface. As such, both the magnification and the diffusion characteristics can be varied in a controlled manner over the surface of the light fixture optics.

Figure 6:
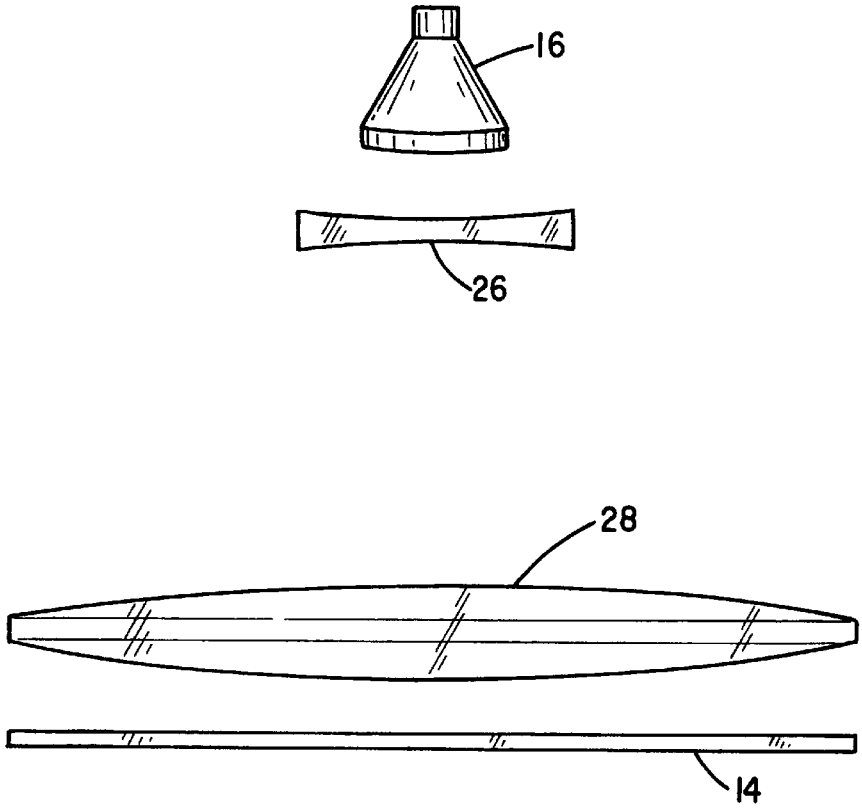
FIG. 6 illustrates an embodiment in which two lenses are used for light source image magnification.

FIG. 6 illustrates an embodiment in which two lenses are used for light source image magnification. More particularly, a first lens 26 comprises a concave negative focal length lens and the second lens 28 is a positive focal length lens. The two lenses and the distances between the light source 16, the lens 26 and the lens 28 are selected to provide a desired magnification. A single element diffusor 14 again is used to provide a desired beam pattern.

Figure 7:
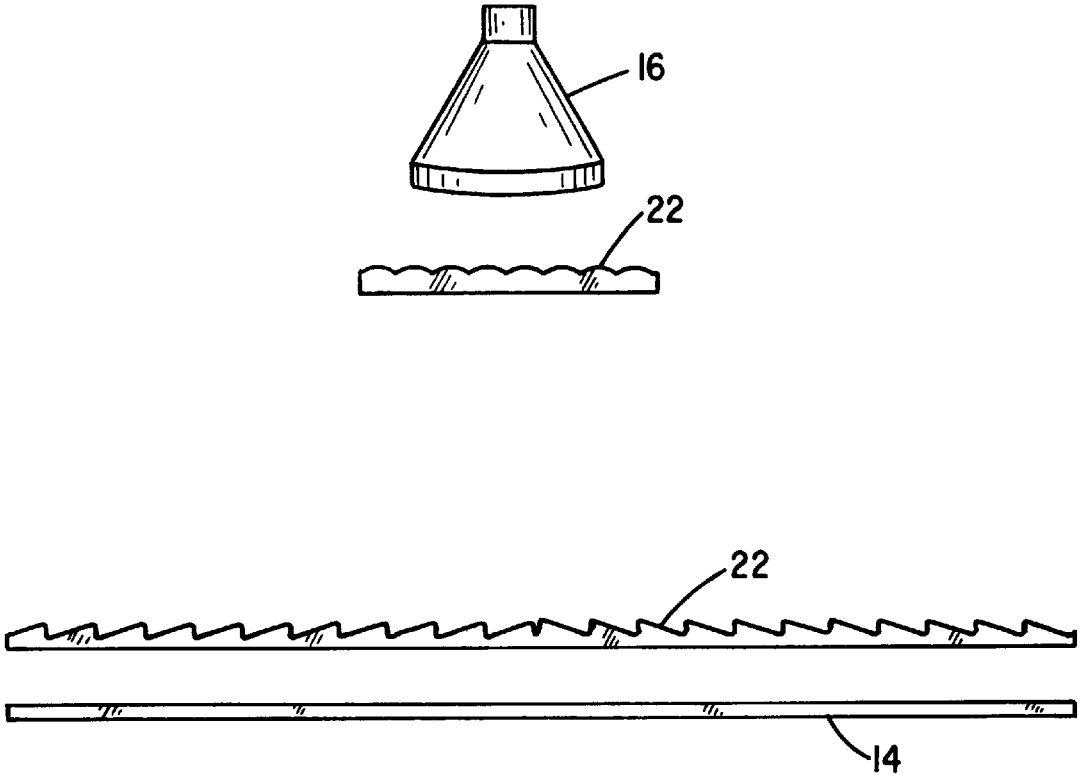
FIG. 7 is a modification of the embodiment illustrated in FIG. 6 in which the two lenses are replaced with Fresnel lenses.

FIG. 7 is included merely to show that the lenses shown in FIG. 6 may be replaced with fresnel lenses 22.

Figure 8:
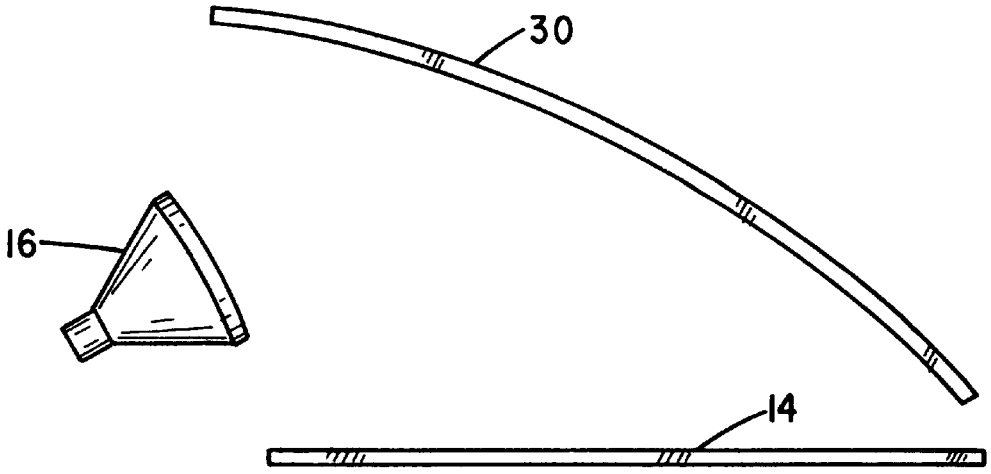
FIG. 8 is an alternative embodiment in which a concave cylindrical mirror is used to provide light source image magnification.

In the embodiment of FIG. 8, rather than using a lens for light source image magnification, a concave cylindrical mirror 30 is used to provide such magnification in only a single dimension. Again, a diffusor intercepts the light rays emanating from the spotlight 16 and reflected off of the concave surface of the curved mirror 30.

Figure 9:
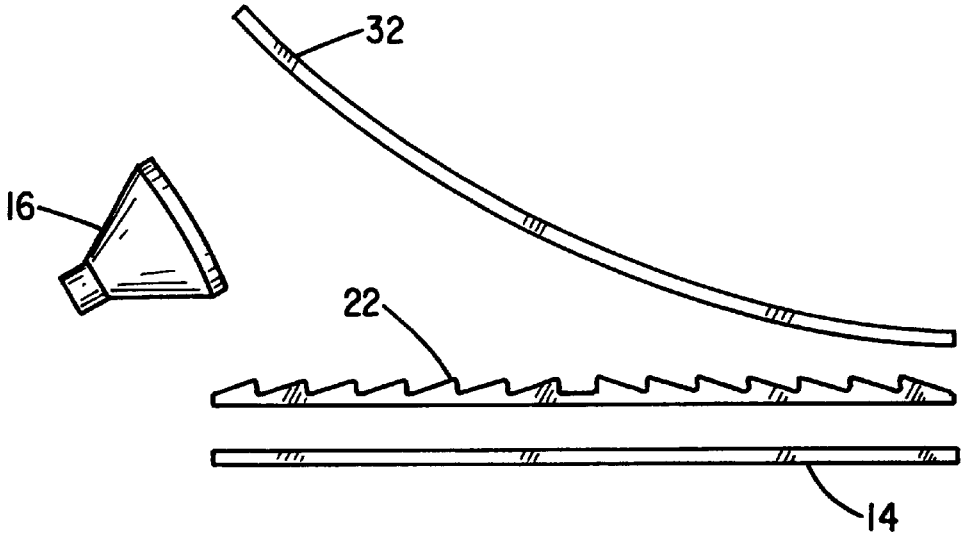
FIG. 9 illustrates a further embodiment in which light source image magnification in one direction is achieved using the combination of a convex cylindrical mirror and a cylindrical fresnel lens having a positive focal length.

FIG. 9 shows an embodiment of the invention in which a convex cylindrical mirror 32 is used to reflect the light beam from spotlight source 16 onto a positive focal length fresnel lens 22 to achieve the desired magnification of the light beam and a diffusor 14 then provides the desired beam pattern. While not illustrated, it should be appreciated that the diffusor layer can be incorporated onto the reflected surface of either the concave or convex mirror surfaces. Furthermore, a cylindrical fresnel lens can be incorporated on the reflective surface to provide independent magnification in a second direction, i.e., a direction other than that of the cylindrical reflector. In general, the order of image magnification and diffusion can be reversed. That is, the light fixture elements can be arranged so that the light first passes through the diffusor 14 and then through the magnifying optics. In this case, care must be taken in locating the diffusor to assure the diffusor's ability to effectively produce beam spreading and minimize light losses.

Figure 10:
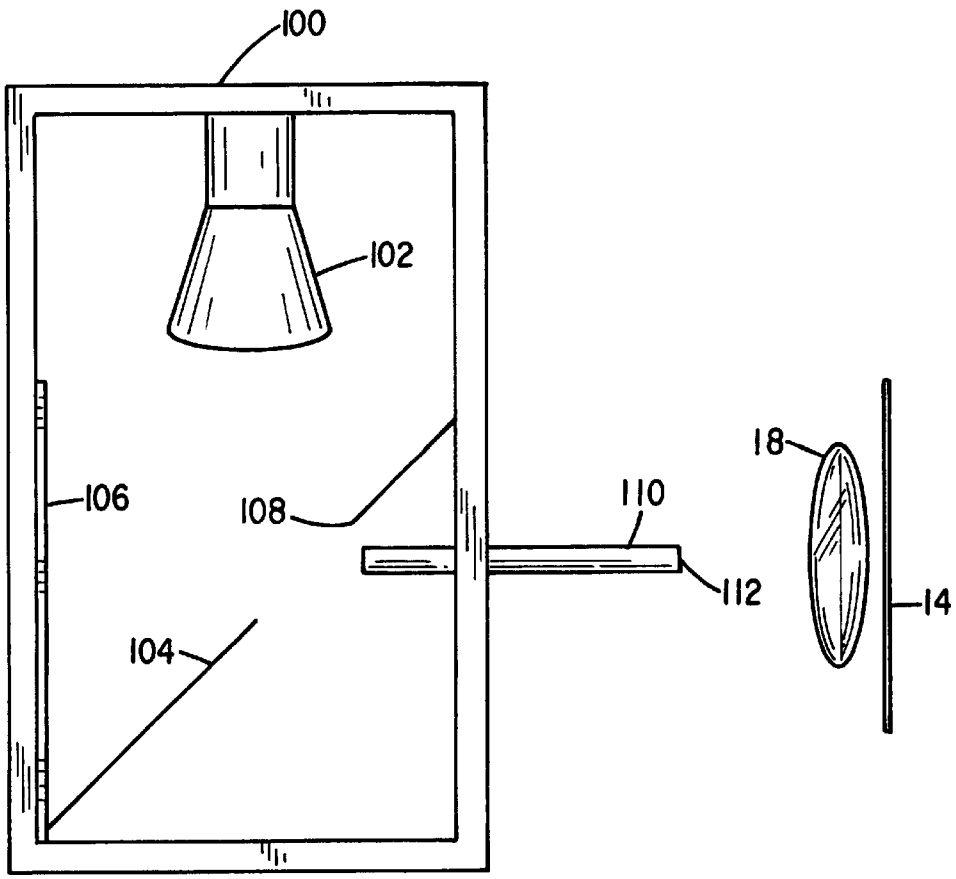
FIG. 10 shows an experimental set-up for evaluating the inventive concept.
Figure 11:
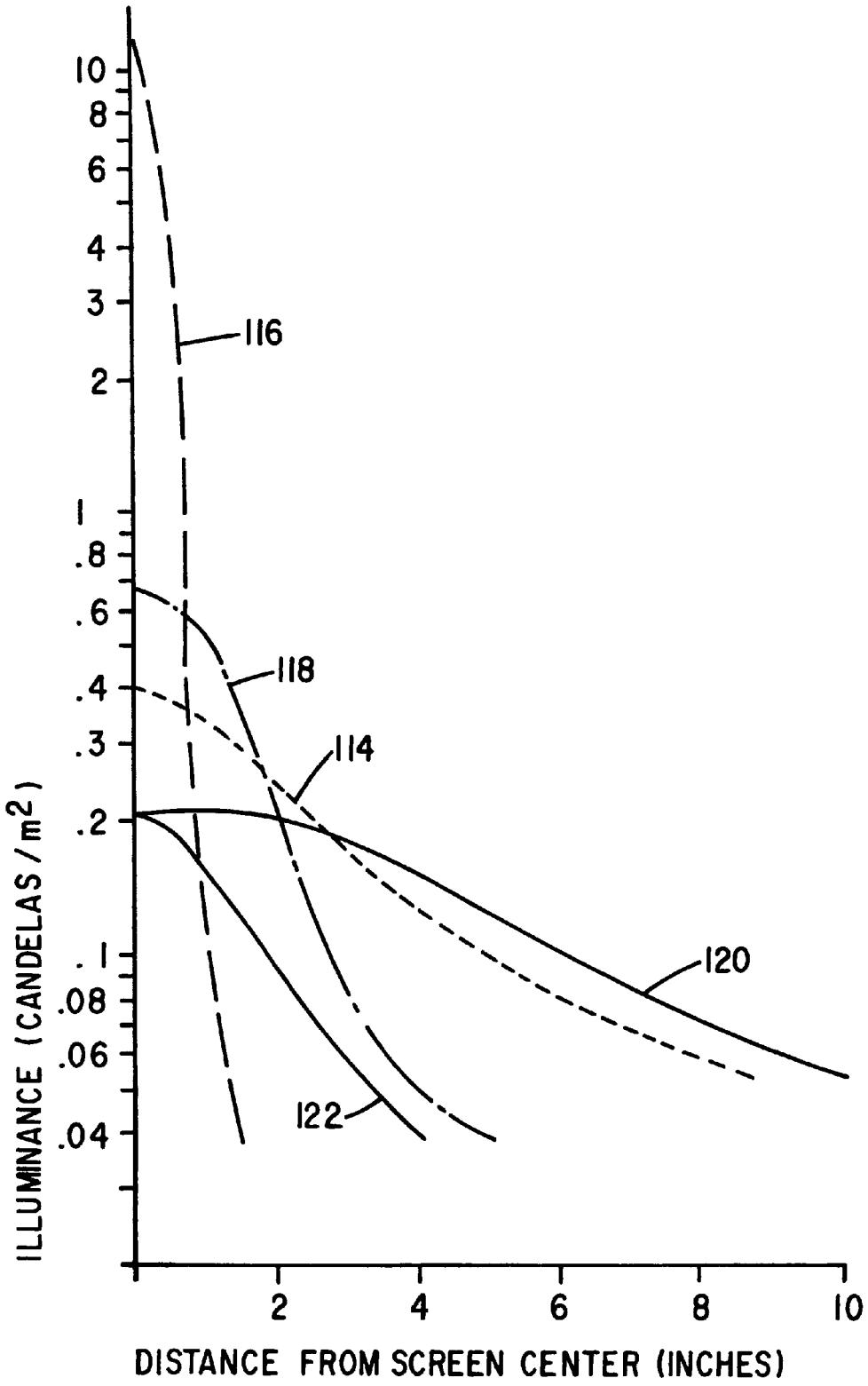
FIG. 11 is a plot showing the light distribution on a screen positioned a predetermined distance from the light source of FIG. 10.

Experiments were conducted using the test apparatus shown in FIG. 10 of the drawings. A light box 100 contained a 60 watt spotlight 102. An aluminum foil reflector 104 was used to redirect the light beam onto a white matte reflective surface 106. The light reflected from the matte surface 106 passed through an aperture 108 in reflector 104 and onto the end of a ⅛ in. diameter acrylic rod 110 which functioned as a small diameter light source. Luminance (brightness) readings were taken both at the output of the acrylic rod itself and on a white surface placed approximately 7 in. from the opposite end 112 of the acrylic light pipe 110. The plot of FIG. 11 shows the light distribution on the screen as a function of the distance from the center of the screen in inches where the light source is aimed at the center of the screen. Curve 114 is for the ⅛ in. diameter light source alone. Curve 116 is for the light source in combination with a 1 in. magnifying lens. Curve 118 shows the effect of introducing a 25° holographic diffusor between the magnifying lens and the white screen. Curves 120 and 122, respectively, show the effect of introducing a 30°×100° holographic diffusor between the light image magnification lens and the white screen, curve 120 being for the major axis and curve 122 for the minor axis of the diffusor.

Figure 12:
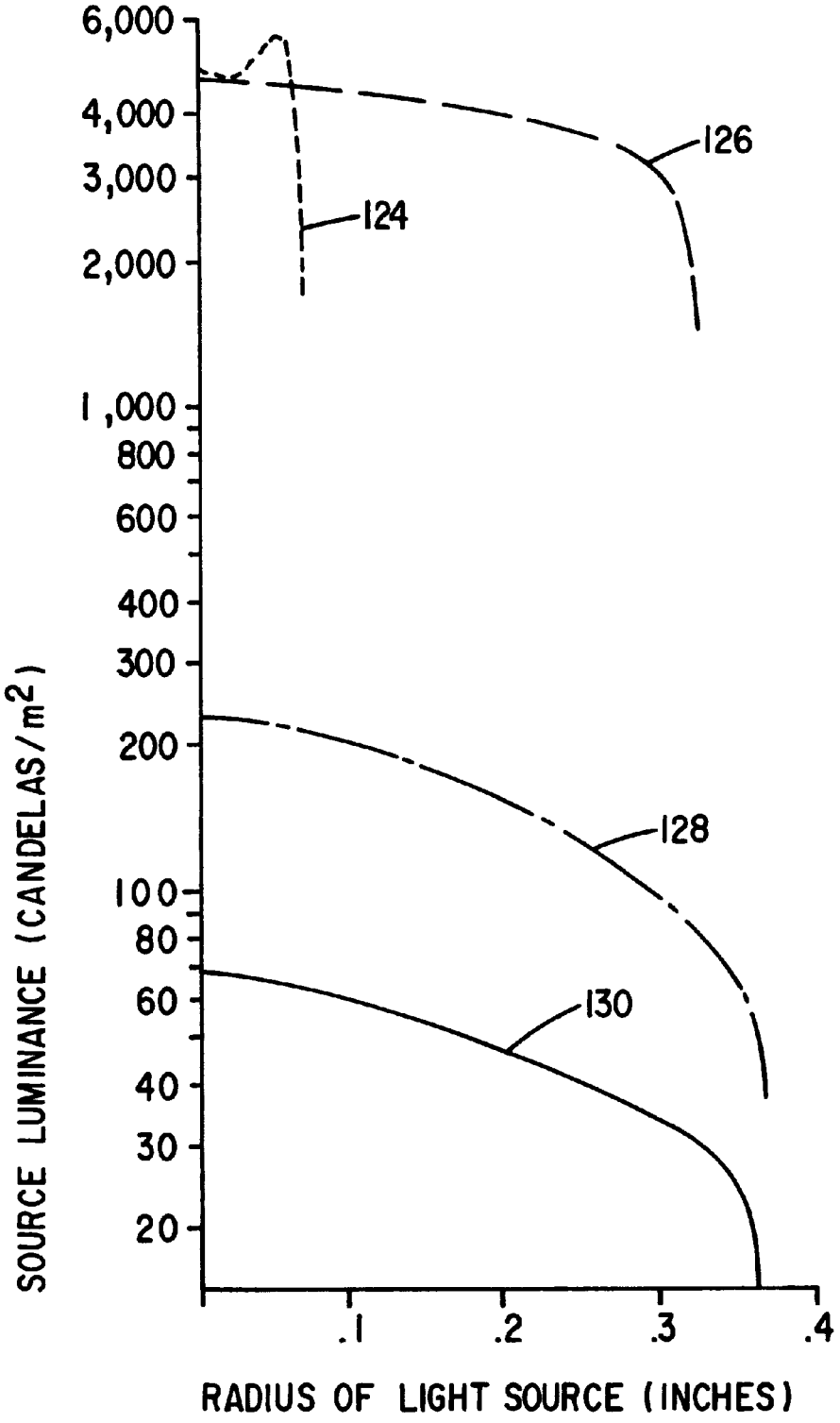
FIG. 12 is a plot of the source illuminance as a function of light source size.

The curve of FIG. 12 shows a plot of the source illuminance, as a function of the radius of the light source. Curve 124 is for the output at the end of the ⅛ in. diameter acrylic rod while curve 126 is with a magnifying lens introduced. Clearly, the size of the light image is greatly increased, but without an appreciable fall-off in luminance. The brightness or luminance is greatly dropped by the introduction of a diffusor along with the lens, as shown by curves 128 and 130 for a 25° holographic diffusor and for a 30°×100° elliptic diffusor, respectively.

The experiment demonstrates the ability to reduce source brightness while still continuing to maintain adequate illumination through the use of light image magnification in combination with an etched glass or a holographic diffusor.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A reduced glare light fixture comprising:

(a) a light source having a predetermined size and surface luminance;

(b) means for creating a magnified image of said light source without significant loss in surface luminance from the predetermined surface luminance of the light source; and (c) diffusor means positioned to receive only the magnified image of the light source and not the image of the light source itself for decreasing the surface luminance of the magnified image of the light source to a desired level.

2. The reduced glare light fixture of claim 1 wherein the means for creating a magnified image of said light source is at least one lens.

3. The reduced glare light fixture of claim 1 wherein the means for creating a magnified image of the light source is one of a convex and a concave reflector.

4. The reduced glare light fixture of claim 1 wherein the diffusor means is a frosted, translucent planar sheet of material.

5. The reduced glare light fixture of claim 1 wherein the diffusor means is a holographic light shaping diffusor.

6. The reduced glare light fixture of claim 5 wherein the holographic light shaping diffusor has a circular distribution angle.

7. The reduced glare light fixture of claim 5 wherein the holographic light shaping diffusor has an elliptical distribution angle.

8. The reduced glare light fixture of claim 2 wherein the at least one lens is a convex lens positioned a predetermined distance from the light source to obtain a desired magnification of said light source.

9. The reduced glare light fixture of claim 8 wherein the convex lens is a Fresnel convex lens and the diffusor means is formed on a surface of the Fresnel convex lens.

10. The reduced glare light fixture of claim 2 wherein the at least one lens includes a negative focal length lens and a positive focal length lens positioned a predetermined distance apart from one another and from the light source to provide a desired magnification of said light source.

* * * * *